US005765080A

United States Patent [19]

Bogoshian

[11] Patent Number: 5,765,080

[45] Date of Patent: Jun. 9, 1998

[54] MAGNETIC DEVELOPMENT ZONE TONER SUPPLY ENHANCEMENT

[75] Inventor: Gregory V. Bogoshian, Rochester, N.Y.

[73] Assignee: Xerox Corporation, Stamford, Conn.

[21] Appl. No.: 664,598

[22] Filed: Jun. 17, 1996

[51] Int. Cl.[6] ..... G03G 15/06

[52] U.S. Cl. ..... 399/275; 399/104; 399/272; 399/273; 399/274

[58] Field of Search ..... 399/104, 275, 399/267, 272, 273, 274

[56] References Cited

U.S. PATENT DOCUMENTS

| | | | |
|---|---|---|---|
| 4,244,322 | 1/1981 | Nomura et al. | 399/275 |
| 4,387,664 | 6/1983 | Hosono et al. | 399/275 |
| 4,406,536 | 9/1983 | Suzuki et al. | 399/259 |
| 4,496,240 | 1/1985 | Yamashita et al. | 399/53 |
| 4,517,274 | 5/1985 | Honda et al. | 399/267 X |
| 4,559,899 | 12/1985 | Kan et al. | 399/104 |
| 4,583,490 | 4/1986 | Kan et al. | 399/275 |
| 4,637,706 | 1/1987 | Hosoi et al. | 399/275 |
| 4,637,973 | 1/1987 | Shigeta et al. | 399/267 X |
| 4,660,958 | 4/1987 | Egami et al. | 399/273 |
| 4,774,543 | 9/1988 | Yoshikawa et al. | 399/267 X |
| 5,072,690 | 12/1991 | Ishikawa et al. | 399/275 |
| 5,424,820 | 6/1995 | Bares et al. | 399/350 |
| 5,659,869 | 8/1997 | Sasaki et al. . | |

FOREIGN PATENT DOCUMENTS 61-3152 1/1986 Japan .

*Primary Examiner*—Nestor Ramirez

[57] ABSTRACT

A method and apparatus for delivering a uniform supply of toner to a development zone in an electrostatographic system is disclosed. Additional toner control in the form of magnets located near the donor member attract toner to the toner pick-up area and insure that a constant supply of toner reaches the development zone. The additional control of toner is especially useful when the supply of toner to the toner pick-up area is limited or the toner does not naturally flow to the toner pick-up area.. The toner supply is enhanced by a stationary magnet located adjacent the donor member and a magnet located on the charge metering blade. Both of the additional toner supply magnets form magnetic brushes of toner particles on the donor member surface, these magnetic brushes insuring a constant supply of toner to the development zone despite problematic development conditions.

18 Claims, 3 Drawing Sheets

MAGNETIC DEVELOPMENT ZONE TONER SUPPLY ENHANCEMENT

This invention relates generally to a developing system for xerography, and more particularly concerns an apparatus and method for moving toner to a magnetic development zone.

In the well-known process of xerography, or electrophotographic printing, a charge retentive surface, known as a photoreceptor, is electrostatically charged, and then exposed to a light pattern of an original image to selectively discharge the surface in accordance with the original image. The resulting pattern of charged and discharged areas on the photoreceptor form an electrostatic charge pattern, known as a latent image. The latent image is developed by contacting it with a finely divided electrostatically attractable powder known as toner. Toner is held on the image areas by the electrostatic charge on the photoreceptor surface. Thus, a toner image is produced in conformity with a light image of the original image being reproduced. The toner image may then be transferred to a substrate or support member (e.g., paper) and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS) where a charged surface may be imagewise discharged in a variety of ways.

In the process of electrophotographic printing, the step of conveying toner to the latent image on the photoreceptor is known as development. The object of effective development of a latent image on the photoreceptor is to convey toner particles to the latent image at a controlled rate so that the toner particles effectively adhere electrostatically to the appropriately-charged areas on the latent image.

A commonly used development technique involves a single-component developer material. In a typical single-component development system, each toner particle has both magnetic properties (to allow the particles to be magnetically conveyed to the photoreceptor) and an electrostatic charge (to enable the particles to adhere to the photoreceptor). In such a system, the developer roll is in the form of a cylindrical sleeve which rotates about a stationary magnet assembly. The magnetized toner particles adhere to the rotating sleeve by the force of the stationary magnets within the sleeve. As the sleeve rotates around the magnets, particles adhering to the sleeve are exposed to an alternating series of magnetic polarities.

A charge/metering or C/M blade is typically in continuous contact with the toner particles on the sleeve along one longitude of the developer roll. The C/M blade performs two simultaneous functions: it allows a uniform metered layer of toner to pass underneath, and uniformly charges the toner that is metered by mechanical means. That is, the action of the toner particles rubbing against the blade and each other while being metered by the blade induces a charge on the toner particles. The uniformity of the nip formed between the blade and the developer roll plays a significant role in creating a uniform charge of toner across the development roll. Charge sharing among particles, charge polarity and charge level are also controlled through the use of charge control additives loosely attached to the surface of the toner particles.

When this thin layer of uniformly-charged particles is obtained, the developer roll advances the toner particles to a development zone adjacent the surface of the photoreceptor. In the development zone, the toner particles adhering magnetically to the developer roll are attracted electrostatically to the latent image recorded on the photoreceptor. AC and DC biases may be applied to the donor roll to enhance and control this process.

Single-component developers which are comprised mainly of toner particles having magnetic properties are particularly useful in a special segment of the electrophotographic printing market, the creation of magnet ink character recognition (MICR) documents. MICR documents are documents, such as checks, wherein the ink or toner forming the characters themselves has magnetic properties which are readable by special reading devices. As is well-known, MICR characters as appear on checks are printed in special fonts by which each character creates a signature pattern of magnetic flux which can be recognized by a recognition program when the characters are run past a magnetic read head. Thus, in a single-component development system, the same magnetic properties which enable the toner to be conveyed around a developer roll are also useful for creating the magnetic properties of the characters on a sheet.

The dimensions and thickness of the MICR printed characters affect the signal strength read by the magnetic read head which makes the uniform supply of toner to the developer roll critical for proper character interpretation. Often, toner has poor flow characteristics, especially in the case of toners containing wax in the melt-mix, and additional control of the toner flow is necessary to insure uniform toner delivery.

Particular developing conditions also lead to poor toner supply. One developing condition occurs when high solid area coverage depletes the toner for the donor roll within the first revolution of the donor roll, requiring additional toner to be supplied. Another developing condition is related to poor toner flow, for example, wax loaded toner preventing fresh toner from jumping to the development zone. Yet another developing condition occurs at the end of the developer cartridge life when the usual method of toner supply is often not sufficient and must be enhanced to provide the proper supply of toner.

The following disclosures may be relevant to various aspects of the present invention:

U.S. Pat. No. 4,387,664
Inventor: Hosono et al.
Issued: Jun. 14, 1983

U.S. Pat. No. 4,406,536
Inventor: Suzuki et al.
Issued Sep. 27, 1983

U.S. Pat. No. 4,496,240
Inventor: Yamashita et al.
Issued: Jan. 29, 1985

U.S. Pat. No. 4,583,490
Inventor: Kan et al.
Issued Apr. 22, 1986

U.S. Pat. No. 4,637,706
Inventor: Hosoi et al.
Issued: Jan. 20, 1987

U.S. Pat. No. 4,660,958
Inventor: Egami et al.
Issued: Apr. 28, 1987

U.S. Pat. No. 5,424,820
Inventor: Bares et al.
Issued Jun. 13, 1995

The relevant portions of the foregoing disclosures may be briefly summarized as follows:

U.S. Pat. No. 4,387,664 discloses a donor roll which generates a fixed magnetic field and a magnetic element in the magnetic field which act together to limit the thickness of developer on the donor roll. In several embodiments, the magnetic element is a doctor blade that blocks the passage of toner except a small amount dragged by the surface of the donor roll. The doctor blade may be magnetic or a magnet.

U.S. Pat. No. 4,406,536 teaches a magnetic brush-type developing device using a one-component developer in an electrophotographic copier. There is a scraper with a magnetic wire disposed in close proximity to a developing sleeve, the magnetic wire agitating and mixing the developer for developing and supplying a fresh supply of developer to the developing sleeve. U.S. Pat. No. 4,496,240 is drawn to a developing apparatus for developing an electrostatic latent image with magnetic toner. A magnet located at the toner outlet of a toner tank controls the amount of magnetic toner supplied through the toner outlet to the developing tank by selectively rotating when a toner detector indicates that more toner is needed U.S. Pat. No. 4,583,490 discloses forming a thin developer layer on a developer carrying member with a latent image being developed by the developer. Various additional magnets are associated with the developer housing to perform functions such as circulating the developer material near the developer carrying member, forming a magnetic brush and sealing the developer housing.

U.S. Pat. No. 4,637,706 teaches a developing apparatus, including a developer supply container having an opening for containing non-magnetic and magnetic particles and a rotating developer carrying member for carrying a developer which is movable between the inside and the outside of the developer supply container. A magnetic particle confining member is spaced from the developer carrying member, the developer carrying member having a magnet generating a fixed magnetic field inside. Another magnet is disposed outside of the developer carrying member in proximity with the confining member at an upstream side thereof with respect to movement of the developer carrying member. The magnetic particle confining member, the developer carrying member and the magnet associated with the confining member work together to form a thin layer of one component developer.

U.S. Pat. No. 4,660,958 is drawn to a developing apparatus with a developer supply container having a magnet located within the developer housing that forms a magnetic brush with a magnet inside the carrier member which seals the housing and improves circulation of the magnetic particles. Another magnet is provided upstream of the magnetic particle confining member for additional control of the magnetic particles.

U.S. Pat. No. 5,424,820 discloses a cleaning system for increasing the packing density of a cleaner sump that uses magnetic toner by filling unused sump space. The cleaning system uses a magnetic force to attract the magnetic waste toner to the sump area not filled by gravity assistance alone. The magnetic force is created by a magnet which can be located either inter or external to the sump.

"Magnetic Seals with Donor Roll Development", Xerox Disclosure Journal, Vol. 16, No., p 33–34, January/February 1991 teaches a magnetic brush development system which employs a magnetic brush to load a donor roll. Magnets are positioned adjacent to the donor roll and magnetic brush to magnetically seal the donor roll and magnetic brush roll from contamination. The magnetic seals effectively control toner, dirt, air flow turbulence and carrier bead pick off resulting in copy quality and developer life.

SUMMARY OF THE INVENTION

In accordance with one aspect of the present invention, there is provided an apparatus for applying toner particles to a charge retentive surface to develop an electrostatic latent image thereon including a developer housing with a toner container supporting a supply of toner and defining an intermediate toner supply section. A toner moving member moves the toner from the toner container to the intermediate toner supply section so that a metered amount of toner is supplied to the intermediate toner supply section, the toner container and the intermediate toner supply section being located such that only toner which is moved by the toner moving member enters the intermediate toner supply section. A donor member is located adjacent the intermediate toner supply section which conveys toner particles from the intermediate toner supply section to a development zone on the charge-retentive surface. A first magnetic member is located within the intermediate toner supply section for enhancing the movement of toner to the donor member so that a constant supply of toner particles is supplied to the development zone.

Pursuant to another aspect of the present invention, there is provided a method of applying toner on a charge retentive surface to develop an electrostatic latent image thereon. Toner is moved from a developer housing having a toner cartridge with a supply of toner to an intermediate toner supply section, the toner being moved by a toner moving member which insures that a metered amount of toner is supplied to the intermediate toner supply section, the toner cartridge and the intermediate toner supply section being located such that only toner which is moved by the toner moving member enters the intermediate toner supply section. The toner is attracted to a first magnetic member located in the intermediate toner supply section and then conveyed to a donor member which attracts toner to its surface and is located adjacent the intermediate toner supply section so that a constant amount of toner is supplied to the donor member. The surface of the donor member is moved so that toner attracted to the donor member surface is delivered to the development zone on the charge-retentive surface.

Yet another aspect of the invention is drawn to an apparatus for applying toner particles to a charge retentive surface to develop an electrostatic latent image thereon with: a developer housing having a toner cartridge supporting a supply of toner and defining an intermediate toner supply section. A toner moving member moves the toner from the toner cartridge to the intermediate toner supply section so that a metered amount of toner is supplied to the intermediate toner supply section, the toner cartridge and the intermediate toner supply section being located such that only toner which is moved by the toner moving member enters the intermediate toner supply section. A donor member is located adjacent the intermediate toner supply section which has a donor member surface for conveying toner particles from the intermediate toner supply to a development zone on the charge-retentive surface. A first magnetic member is located within the intermediate toner supply section for enhancing the movement of toner to the donor member so that a constant supply of toner particles is supplied to the development zone. A metering member limits the amount of toner on the donor member surface, the metering member having a first side and a second side, the first side of the metering member being adjacent the donor member, the metering member cooperating with the first magnetic member to control the amount of toner on the donor member and a second magnetic member located on the second side of the metering member.

The present invention is drawn to enhancing the supply of single component toner having magnetic properties to the magnetic development zone of a xerographic printing machine. A magnetic strip is positioned in close proximity to the magnetic donor roll to form a toner brush in the development zone. This configuration provides a constant uniform supply of toner to the development zone in print cartridges where constant toner supply is a problem. The enhanced supply of toner is especially useful when high solid area coverage depletes the toner from the magnetic donor roll and at the end of the print cartridge life when the supply of toner is low. A secondary magnetic strip may be affixed to the back of the charge metering blade providing a secondary toner brush to wrap around the end of the blade.

DRAWINGS

Other features of the present invention will become apparent as the following description proceeds and upon reference to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
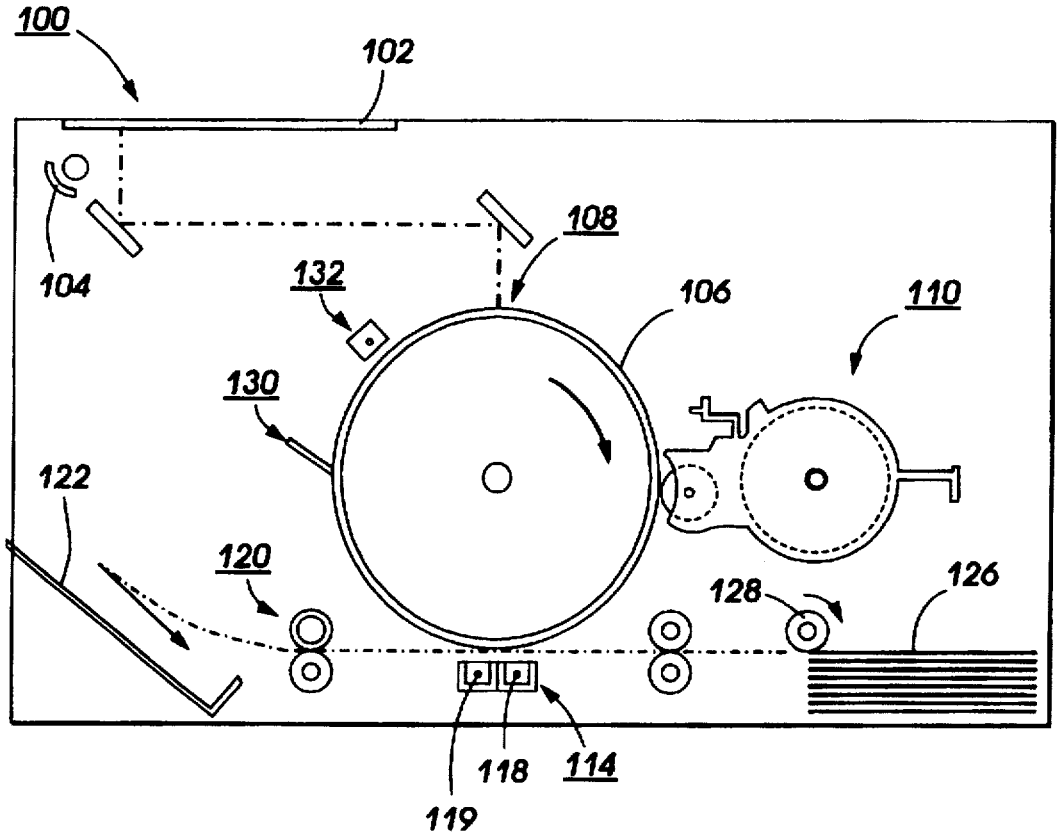
FIG. 3 is an elevational view showing the basic elements of a typical electrophotographic printer.

FIG. 3 shows the basic elements of a typical electrophotographic printer, shown generally by reference numeral 100. In electrophotographic printer 100, a document to be reproduced is placed on a platen 102 where it is illuminated in known manner by a light source such as a lamp 104. The document thus exposed is imaged onto the photoreceptor 106 by a system of mirrors at imaging station 108. The source of the original image to be printed may alternatively be a ROS, wherein a scanning laser moving across the photoreceptor selectively discharges the photoreceptor in accordance with digital image data. In the example copier shown, the photoreceptor 106 is in the form of a rotating drum, although photoreceptors in the form of a belt are also known, and may be substituted therefor. Photoreceptor 106 after imaging supports an electrostatic latent image of the original document recorded on the drum 106. Photoreceptor drum 106 rotates the latent image supported thereon past development unit 110, where the electrostatic latent image is developed, by the application of toner particles. In the case of a single-component development system, toner from a supply hopper is gradually conveyed to a rotating developer roll to a development zone adjacent the latent image recorded on photoreceptor drum 106. The details of the operation of development unit 110 will be described later in the specification.

The developed image is transferred at transfer station 114 from the photoreceptor drum 106 to a copy sheet, which is delivered from a paper supply system into contact with the drum 106 in synchronous relation to the image thereon. At transfer station 114, a transfer corona device 118 provides an electric field to assist in the transfer of the toner particles from the photoreceptor drum 106 to the copy sheet. A detack corona 119 is provided downstream of the transfer corotron 118 for facilitating removal of the copy sheet from the photoreceptor drum. Individual sheets are introduced into the system from a stack of supply paper 126 by a feeder 128. A sheet from stack 126 is fed in the embodiment shown, by further sets of nip roll pairs through a path indicated by the broken line. The image is subsequently fused onto the copy sheet at fusing station 120 and the finished copy is deposited in output tray or hopper 122. After the toner on the drum 106 is transferred to the copy sheet, residual toner is removed from the surface of the photoreceptor drum 106, for example by cleaning blade 132 to prepare the photoreceptor for imagewise discharging of the photoreceptor in a subsequent cycle.

Figure 1:
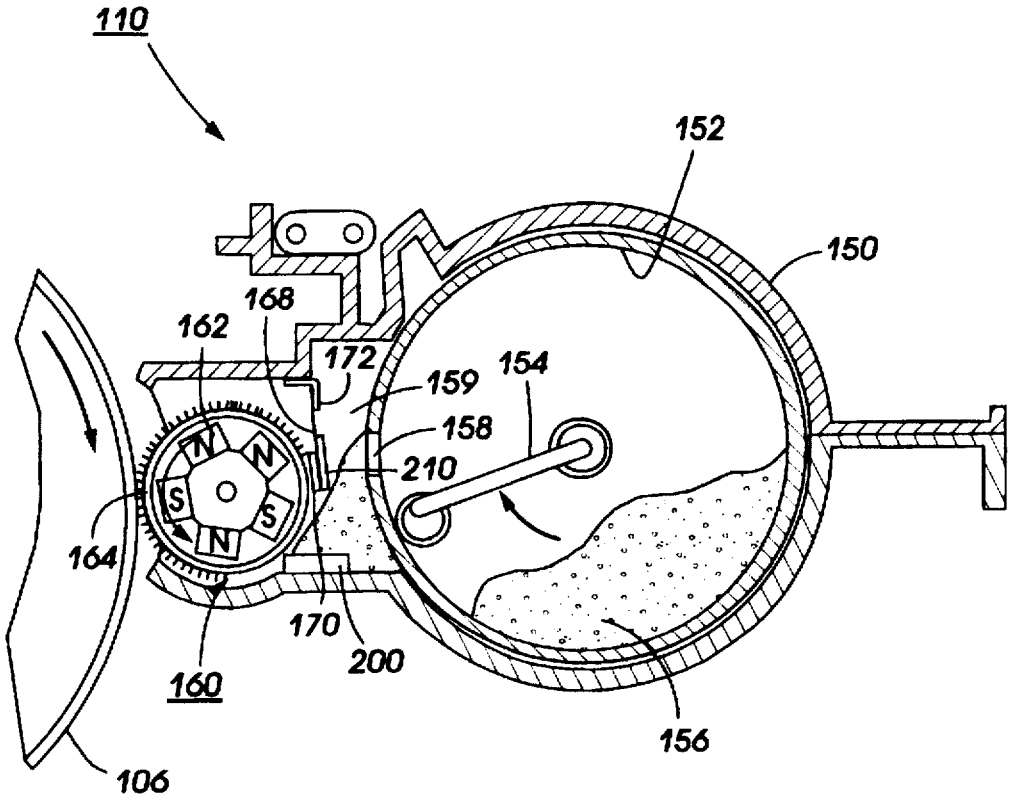
FIG. 1 is a sectional, elevational view showing a detail of the development apparatus of the present invention.

FIG. 1 shows a single-component development unit, generally indicated by reference numeral 110. As typically constructed, the main body of development unit 110 is encased in a developer housing 150. The main part of the developer housing is, in this embodiment, in the form of an enclosed cylindrical space which accommodates a cylindrical toner cartridge 152 shown in cross section. The toner cartridge 152 is typically made of an inexpensive material such as cardboard or aluminum. Toner cartridge 152 is preferably cylindrical so that it may be slid easily into the developer housing. Toner cartridge 152 may include a rotatable agitator 154, which engages a rotating driver in the apparatus. The purpose of agitator 154 is generally to keep the single-component developer (toner) well-mixed and aerated, so that the toner 156 will flow easily and will not coagulate in one area of the toner cartridge 152. Agitator 154 may also be useful in moving toner particles out of the toner cartridge 152 at a consistent rate.

Commonly, toner cartridge 152 includes at least one opening 158 defined therein, so that toner 156 may be gradually taken out of the toner cartridge 152. In the design shown, opening 158 is illustrated as one or more openings along a longitudinal axis of the cylindrical toner cartridge 152, oriented adjacent developer roll 160. In this way, toner 156 may be gradually removed from the toner cartridge 152 and conveyed by a donor member, here shown as a developer roll 160, to the surface of the photoreceptor 106. An intermediate toner supply section 159 is located between the toner cartridge 152 and the developer roll 160.

Developer roll 160 in a single-component development system includes a stationary magnet assembly 162, enclosed within a rotating cylindrical sleeve 164. Stationary magnet assembly 162 includes a plurality of permanent magnets, with each magnet extending substantially the length of the developer roll 160 and being arranged so that a selected pole of each magnet is exposed outward. The alternating polarities of the magnets create magnetic flux lines which extend outward toward the outer surface of the sleeve 164. In a typical single-component development system, the toner particles have magnetic properties associated therewith, for example by virtue of a significant iron content, but generally no specific magnetic polarity. The magnets on magnetic assembly 162 generally cause the toner particles to adhere to the surface of outer sleeve 164, and the rotation of outer sleeve 164 causes the toner particles to, in effect, move around the developer roll 160 from the toner cartridge side of the developer roll 160 to a development zone adjacent the surface of the photoreceptor 106. Although developer roll 160 is shown with a rigid sleeve 164, other members for conveying the toner particles to the development zone, such as, for example, a flexible belt entrained on a plurality of rollers may be used.

Metering blade 168 is typically an angled, resilient blade urged against the surface of the developer roll 160 along the length thereof. The purpose of the metering blade 168 is to smooth out the layer of toner particles on the sleeve 164 so that the layer will be uniform when it is brought into contact with the photoreceptor 106. metering blade 168 also charges the toner. Metering blade 168 is oriented so that the blade points against the process direction of sleeve 164 as it moves in the counterclockwise direction. Disposed at the free end of metering blade 168 is a compressible pad 170, which is typically made of silicone plastic. The metering blade 168 is anchored in position by a blade holder 172.

A magnetic strip 200 is positioned in the development housing in intermediate toner supply section 159 to enhance the movement of the toner to the developer roll. The agitator 154 rotates more slowly than the developer roll, typically one agitator roll rotation per fifteen revolutions of the developer roll. Ensuring a proper a supply of toner to the developer roll is a problem, especially when problematic developing conditions are present. Examples of problematic developing situations include toner with poor flow characteristics as in the case of toners which contain wax in the melt-mix; high solid area coverage which depletes the toner from the developer roll; and at the end of toner cartridge life when the agitator does not supply a constant supply of toner.

Figure 2:
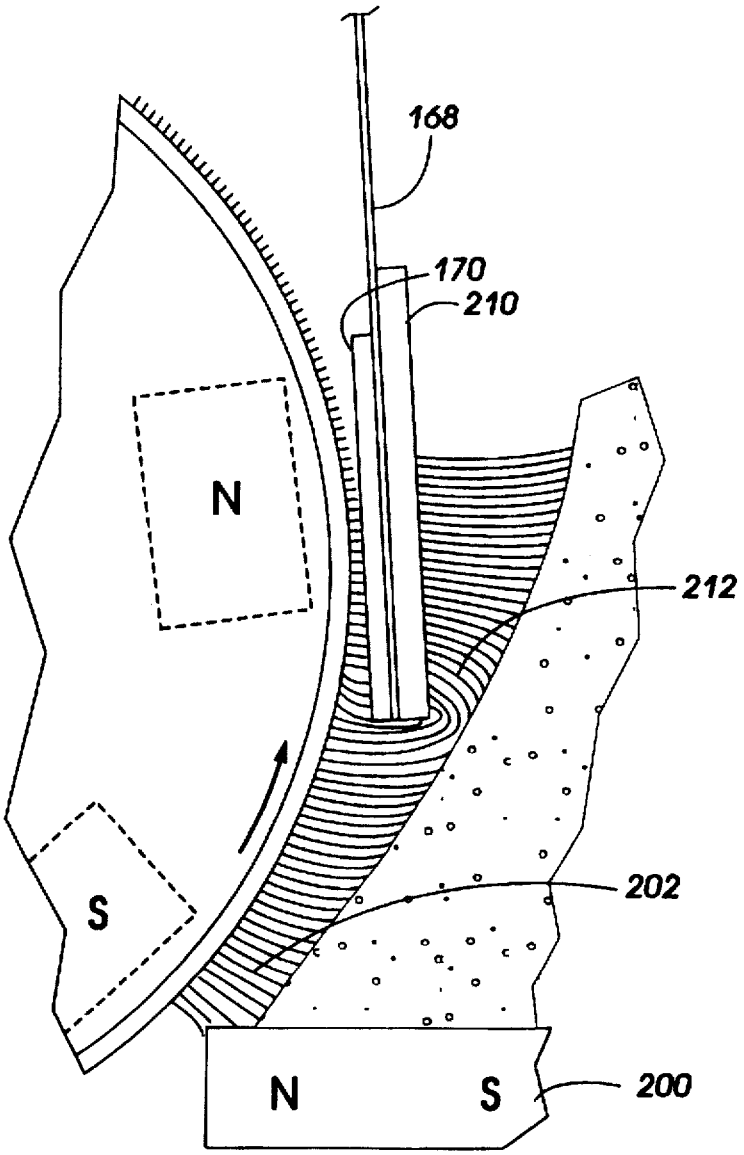
FIG. 2 is an enlarged view of the charge metering area and pick-up zone of FIG. 1.

FIG. 2 shows an enlarged view of the charge metering area and toner pick-up zone, the toner pick-up zone being the area at which the toner from the intermediate toner supply section 159 comes into contact with the developer roll 160. The magnetic field of the magnetic strip 200 must be of sufficient strength to aid in moving toner between the toner cartridge opening 158 and the developer roll, however the magnetic field cannot be too strong to adversely inhibit the flow of toner to the magnetic donor roll. A proper magnetic field strength of the magnetic strip 200 allows a toner brush 202 to form between the magnetic strip and the magnetic donor roll so that a constant amount of toner is continuously supplied to the magnetic donor roll. The magnetic strip 200 and the agitator 154 of the present invention work in conjunction to bring a controlled amount of toner to the toner pick-up zone rather than relying on a gravity fed toner supply system or an additional moving agitator near the toner pick-up zone. In one example resulting in enhanced toner supply, the magnetic strip 200 is a permanent magnet extending the length of the donor roll and attached to a wall of the developer housing near the donor roll. The polarity of magnetic strip 200 is oriented so that it is opposite to the polarity of the donor roll magnet 162 which is nearest to the magnetic strip. This orientation creates a strong magnetic field between the two magnets, which attracts the toner particles to it. Adding the magnetic strip 200 also helps seal the developer housing so that toner will not leak from the developer housing.

Another toner supply enhancement magnet is in the form of a charge metering blade magnet 210. The charge metering blade magnet is located on the back of the charge metering blade spring shim 168, opposite the charge metering blade 170. The charge metering blade magnet attracts toner to the charge metering blade and a toner brush 212 is formed with the donor roll magnets. The toner brush 212 wraps around the end of the charge metering blade which allows additional toner to be supplied to the developer roll 160. In one example the charge metering blade magnet 210 is a combination of alternating north and south poles oriented along the length of the blade with the toner in the intermediate toner supply section being attracted to the alternating magnetic fields. It is also desirable to have the charge metering blade magnet be a flexible magnetic strip so that the flexible nature of the charge metering blade is maintained.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and scope of the appended claims.

I claim:

1. An apparatus for applying toner particles to a charge retentive surface to develop an electrostatic latent image thereon, comprising:

a developer housing having a toner container supporting a supply of toner and defining an intermediate toner supply section;

a toner moving member for moving the toner from the toner container to the intermediate toner supply section so that a metered amount of toner is supplied to the intermediate toner supply section, the toner container and the intermediate toner supply section being located such that only toner which is moved by the toner moving member enters the intermediate toner supply section;

a vertical wall with at least one opening defined therein located between the toner container and the intermediate toner supply section, the toner container and the intermediate toner supply section being connected by said opening and said opening being generally free of obstructions;

the toner moving member located in the toner container for moving toner particles in a lateral direction from the toner container to the intermediate toner supply section through the opening in the wall, the toner moving member and the opening in the wall interacting to meter the amount of toner supplied to the intermediate toner supply section;

a donor member located adjacent the intermediate toner supply section and having a donor member surface for conveying toner particles from the intermediate toner supply section to a development zone on the charge-retentive surface; and a first magnetic member located within the intermediate toner supply section for enhancing the movement of toner to the donor member so that a constant supply of toner particles is supplied to the development zone, wherein the first magnetic member is a stationary magnet attached to the lowermost portion of the intermediate toner supply section having a first magnetic member pole and a second magnetic member pole, the first magnetic member pole being closer to the donor member than the second magnetic member pole.

2. The apparatus for applying toner particles as claimed in claim 1, wherein the donor member has a donor member magnet with a first donor member magnet pole and a second donor member magnet pole located within the donor member, the donor member magnet being in close proximity to the first magnetic member, the donor member magnet being oriented so that the first donor magnet pole is closer to the first magnetic member than the second donor member magnet pole;

and the first magnetic member pole and the first donor member magnet pole have opposite polarities which generates a magnetic field between the first magnetic member and the donor member magnet to which toner in the intermediate toner supply section is attracted.

3. The apparatus for applying toner particles as claimed in claim 1, further comprising:

a metering member which limits the amount of toner on the donor member surface, the metering member having a first side and a second side, the first side of the metering member being adjacent the donor member, the metering member cooperating with the first magnetic member to control the amount of toner on the donor member; and a second magnetic member located on the second side of the metering member.

4. The apparatus for applying toner particles as claimed in claim 3, further comprising:

a second magnetic brush of toner particles formed between the second magnetic member and the donor member.

5. The apparatus for applying toner particles as claimed in claim 1, further comprising:

a metering member which limits the amount of toner on the donor member, the metering member having a first side and a second side, the first side of the metering member being adjacent the donor member, said first magnetic member being located on the second side of the metering member.

6. The apparatus for applying toner particles as claimed in claim 5, wherein the first magnetic member is a flexible magnet.

7. The apparatus for applying toner particles as claimed in claim 1, wherein the toner moving member in the toner container is the sole moving toner stirring member in the developer housing.

8. A method of applying toner on a charge retentive surface to develop an electrostatic latent image thereon, comprising:

moving toner from a developer housing having a toner cartridge with a supply of toner to an intermediate toner supply section, the toner being moved by a toner moving member which insures that a metered amount of toner is supplied to the intermediate toner supply section, the toner cartridge and the intermediate toner supply section being located such that only toner which is moved by the toner moving member through an opening in a vertical wall separating the toner cartridge and the intermediate toner supply section so that the toner enters the intermediate toner supply section in a lateral direction;

attracting toner to a first magnetic member located in the intermediate toner supply section;

conveying toner from the first magnetic member to a donor member which attracts toner to its surface and is located adjacent the intermediate toner supply section so that a constant amount of toner is supplied to the donor member; and moving the surface of the donor member so that toner attracted to the donor member surface is delivered to a development zone on the charge-retentive surface, wherein the first magnetic member is a stationary magnet attached to the lowermost portion of the intermediate toner supply section.

9. The method of applying toner as claimed in claim 8, wherein the toner moving step further comprises agitating the toner with the toner moving member.

10. The method of applying toner as claimed in claim 8, further comprising:

limiting the amount of toner supplied to the donor member with a metering blade in cooperation with the first magnetic member for controlling the amount of toner on the donor member surface.

11. The method of applying toner as claimed in claim 10, wherein said attracting step further comprises:

attracting toner to the donor member with a second magnetic member located on the metering blade.

12. The method of applying toner as claimed in claim 11, further comprising:

forming a second magnetic brush of toner particles between the second magnetic member and the donor member surface.

13. The method of applying toner as claimed in claim 8, wherein the toner moving member in the toner container is the sole moving toner stirring member in the developer housing.

14. An apparatus for applying toner particles to a charge retentive surface to develop an electrostatic latent image thereon, comprising:

a developer housing having a toner cartridge supporting a supply of toner and defining an intermediate toner supply section;

a toner moving member for moving the toner from the toner cartridge to the intermediate toner supply section so that a metered amount of toner is supplied to the intermediate toner supply section, the toner cartridge and the intermediate toner supply section being located such that only toner which is moved by the toner moving member in a lateral direction enters the intermediate toner supply section;

a donor member located adjacent the intermediate toner supply section and having a donor member surface for conveying toner particles from the intermediate toner supply to a development zone on the charge-retentive surface;

a first magnetic member located within the intermediate toner supply section for enhancing the movement of toner to the donor member so that a constant supply of toner particles is supplied to the development zone;

a metering member which limits the amount of toner on the donor member surface, the metering member having a first side and a second side, the first side of the metering member being adjacent the donor member, the metering member cooperating with the first magnetic member to control the amount of toner on the donor member; and a second magnetic member located on the second side of the metering member, the second magnetic member attracting toner to the metering member, wherein the second magnetic member is a flexible strip magnet.

15. An apparatus as claimed in claim 14, wherein the first magnetic member is a stationary magnet.

16. The apparatus for applying toner particles as claimed in claim 14, further comprising:

a vertical wall with at least one opening defined therein located between the toner cartridge and the intermediate toner supply section, the toner cartridge and the intermediate toner supply section being connected by said opening and said opening being generally free of obstructions;

the toner moving member located in the toner cartridge for moving toner particles from the toner cartridge to the intermediate toner supply section through the opening in the wall, the toner moving member and the opening in the wall interacting to meter the amount of toner supplied to the intermediate toner supply section.

17. The apparatus for applying toner particles as claimed in claim 14, wherein the toner moving member in the toner cartridge is the sole moving toner stirring member in the developer housing.

18. An apparatus for applying toner particles to a charge retentive surface to develop an electrostatic latent image thereon, comprising:

a developer housing having a toner container supporting a supply of toner and defining an intermediate toner supply section;

a toner moving member for moving the toner from the toner container to the intermediate toner supply section so that a metered amount of toner is supplied to the intermediate toner supply section, the toner container and the intermediate toner supply section being located such that only toner which is moved by the toner moving member enters the intermediate toner supply section;

a vertical wall with at least one opening defined therein located between the toner container and the intermediate toner supply section, the toner container and the intermediate toner supply section being connected by said opening and said opening being generally free of obstructions;

the toner moving member located in the toner container for moving toner particles in a lateral direction from the toner container to the intermediate toner supply section through the opening in the wall, the toner moving member and the opening in the wall interacting to meter the amount of toner supplied to the intermediate toner supply section;

a donor member located adjacent the intermediate toner supply section and having a donor member surface for conveying toner particles from the intermediate toner supply section to a development zone on the charge-retentive surface;

a first magnetic member located within the intermediate toner supply section for enhancing the movement of toner to the donor member so that a constant supply of toner particles is supplied to the development zone; and a metering member which limits the amount of toner on the donor member, the metering member having a first side and a second side, the first side of the metering member being adjacent the donor member, said first magnetic member being located on the second side of the metering member, wherein the first magnetic member is a flexible magnet.

* * * * *